US006817334B2

(12) United States Patent
Gould

(10) Patent No.: US 6,817,334 B2
(45) Date of Patent: Nov. 16, 2004

(54) INTAKE PORT SLEEVE FOR AN INTERNAL COMBUSTION ENGINE

(75) Inventor: DeForest C. Gould, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/301,645

(22) Filed: Nov. 22, 2002

(65) Prior Publication Data

US 2004/0099238 A1 May 27, 2004

(51) Int. Cl.[7] ..... F01N 3/00
(52) U.S. Cl. ..... 123/193.5
(58) Field of Search ..... 123/193.5; 29/888.06, 29/888.061

(56) References Cited

U.S. PATENT DOCUMENTS 4,089,164 A 5/1978 Iwasa
4,117,672 A 10/1978 Yamazaki et al.
4,168,610 A 9/1979 Engquist
4,206,598 A * 6/1980 Rao et al. ..... 123/193.5
4,207,660 A * 6/1980 Rao et al. ..... 123/193.5
4,430,856 A * 2/1984 Niedert ..... 123/193.5
5,239,956 A * 8/1993 Keelan et al. ..... 123/193.5
5,414,993 A 5/1995 Kon
5,552,196 A 9/1996 Haselkorn et al.
5,593,745 A 1/1997 Haselkorn et al.
5,842,342 A * 12/1998 Strasser et al. ..... 123/193.5
6,067,973 A 5/2000 Chanda et al.
6,289,884 B1 * 9/2001 Blandino et al. ..... 123/585
6,314,950 B1 11/2001 Burbank et al.
6,390,051 B2 * 5/2002 Hilpert et al. ..... 123/193.5

* cited by examiner

*Primary Examiner*—Marguerite McMahon
(74) *Attorney, Agent, or Firm*—Roland G McAndrews; Ryan C Stockett

(57) ABSTRACT

An engine includes a cylinder block having at least one cylinder bore, a cylinder head connected to the cylinder block, and an intake manifold connected to the cylinder head. The cylinder head includes an intake port located upstream of a cylinder bore of the at least one cylinder bore, the intake port providing a passageway between the intake manifold and a cylinder bore of the at least one cylinder bore. An intake port sleeve is located at least partially within the intake port.

17 Claims, 1 Drawing Sheet

INTAKE PORT SLEEVE FOR AN INTERNAL COMBUSTION ENGINE

TECHNICAL FIELD

This invention relates generally to an intake port of an internal combustion engine, and more particularly to an intake port sleeve located in an intake port of an internal combustion engine.

BACKGROUND

In recent years, internal combustion engine manufacturers have been faced with ever increasing demand for greater horsepower within a preestablished engine envelope and regulatory requirements. The regulatory requirements have been directed mainly at exhaust emissions. To meet the exhaust emission requirements, fuel consumption has increased. Different forms of airflow management systems have been designed to improve emissions and fuel consumption.

One well-known form of air flow management increases the amount of intake air available for combustion in the combustion chambers of the engine. Typically this is accomplished by pressurizing the intake air with a turbocharger system. The turbocharger system commonly includes a compressor section driven by a turbine section. The exhaust gasses from the engine drives the turbine section and the compressor section compresses engine intake air.

Unfortunately, the pressurization process increases the temperature of the intake air, which results in an increased combustion temperature and an increase in engine $NO_x$ emissions. To reduce the intake air temperature in such systems, a fluid cooler is placed downstream of the compressor section of the turbocharger system. The fluid cooler reduces the temperature of the intake air to within a desired range associated with improved engine preformance.

As noted above, common turbocharger systems are driven by exhaust gasses from the engine. In order to maximize the efficiency of such systems, it is important to maintain the exhaust gasses at the highest temperatures possible. The higher the temperature of the exhaust gasses, the greater the expansion energy extracted by the turbocharger system, and the greater the compression of the intake air by the compressor section. Thus, it is important to reduce the amount of heat loss from the exhaust gasses during flow of the exhaust gasses from the combustion chamber to the turbine section of the turbocharger system.

U.S. Pat. No. 5,414,993 to Kon addresses the problem of heat loss of exhaust gasses traveling from the combustion chamber of the engine to the turbocharger system. The engine system of Kon includes exhaust port liners located within the cylinder head of the engine for insulating the exhaust gases from the cylinder head. Thus, the amount of heat transferred from the exhaust gasses to the cylinder head is reduced. As noted above, this results in improved energy extraction by the turbocharger, which results in higher compression of the intake air. U.S. Pat. No. 5,414,993, however does not address the need to insulate the lower temperature intake air from the higher temperature engine body while the intake air travels through the intake manifold, cylinder head, and cylinder body.

The present invention provides an engine system that avoids some or all of the aforesaid shortcomings in the prior art.

SUMMARY OF THE INVENTION

In accordance with one aspect of the invention, an engine includes a cylinder block having a at least one cylinder bore, a cylinder head connected to the cylinder block and an intake manifold connected to the cylinder head. An intake port is formed in the cylinder head upstream of the at least one cylinder bore, the intake port providing a passageway between the intake manifold and the at least one cylinder bore. The engine further including an intake port sleeve located at least partially within the intake port.

According to another aspect of the present invention, a method for providing intake air flow to a combustion chamber of an engine including compressing the intake air, cooling the compressed intake air in a fluid cooler, and insulating the cooled intake air from the engine during flow through an intake port of the engine to the combustion chamber.

According to yet another aspect of the present invention, an engine system includes a compressor receiving intake air of the engine system, a fluid cooler located downstream of the compressor and configured to receive compressed intake air, and an engine. The engine includes a cylinder block having a at least one cylinder bore, a cylinder head connected to the cylinder block, an intake manifold connected to the cylinder head. At least one intake port is formed in the cylinder head, the intake port providing a passageway between the intake manifold and the at least one cylinder bore. The engine further includes an intake port sleeve, located at least partially within a said intake port.

Additional advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawing, which is incorporated in and constitutes a part of this specification, illustrates an exemplary embodiment of the invention, and together with the description, serves to explain the principles of the invention.

DETAILED DESCRIPTION

Figure 1:
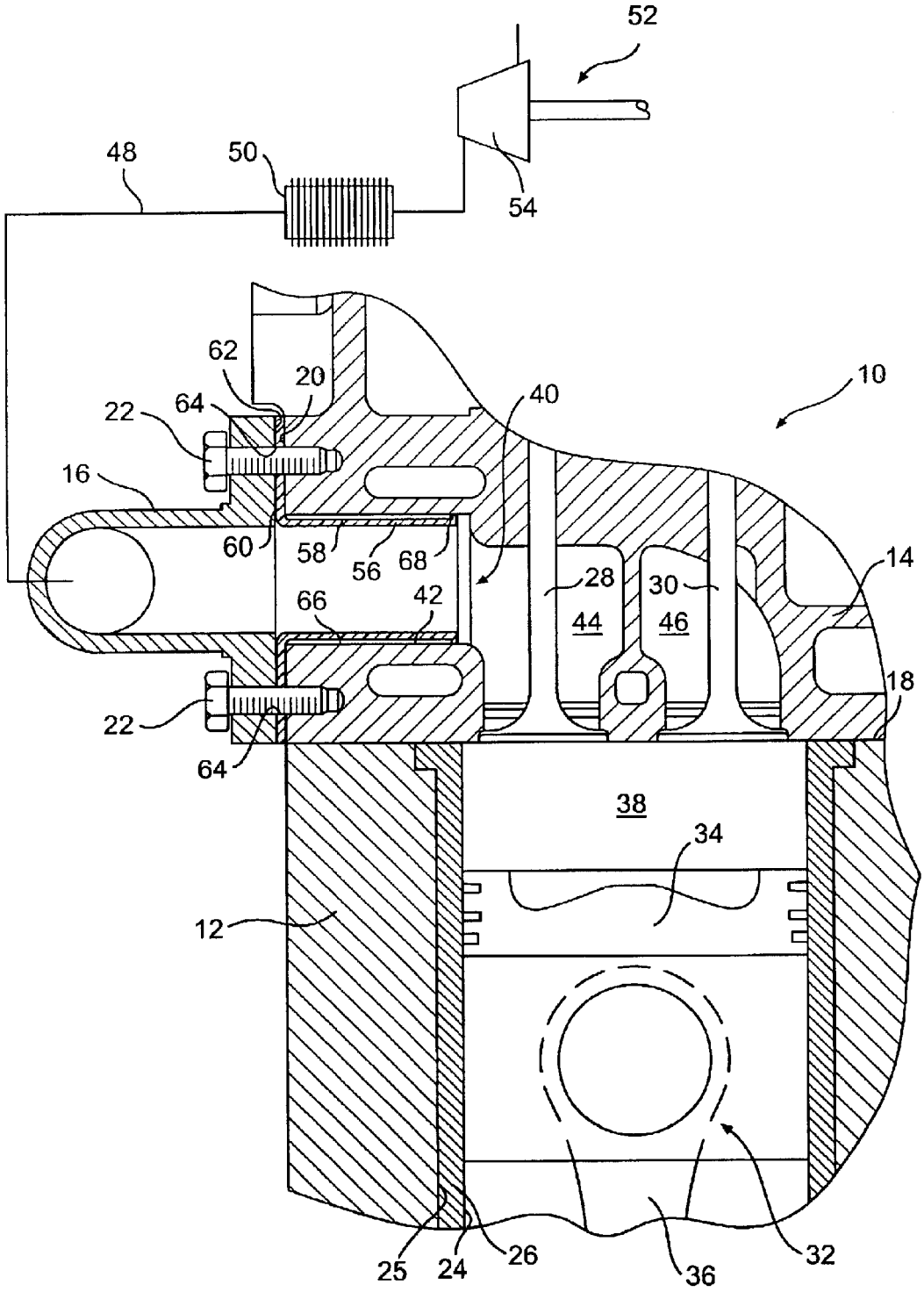
FIG. 1 is a partial section and partial diagrammatic view of an internal combustion engine system according to an exemplary embodiment of the present invention.

Reference will now be made in detail to the exemplary embodiments of the invention, an example of which is illustrated in the accompanying drawing. Wherever possible, the same reference numbers will be used throughout the drawing to refer to the same or like parts.

FIG. 1 illustrates a partial section and partial diagrammatic view of an internal combustion engine generally indicated by reference number 10. Engine 10 may include a cylinder block 12, a cylinder head 14 connected to cylinder block 12, and an intake manifold 16 and exhaust manifold (not shown) connected to cylinder head 14. Cylinder head 14 may be fixedly secured to an outer surface 18 of cylinder block 12 by any suitable arrangement, such as by a plurality of bolts (not shown). Further, intake manifold 16 and exhaust manifold (not shown) may be fixedly secured to an outer mounting surface 20 of cylinder head 14 also by any suitable arrangement, such as a plurality of bolts 22.

Cylinder block 12 may include a plurality of cylinder bores 24. While the description below will reference only one cylinder bore 24, it is understood that each of the plurality of cylinder bores may include the same features. Cylinder bore 24 may be formed within a cylinder liner 26 disposed about a radial surface of an engine block bore 25. Further, cylinder bore 24 may be closed off at one end by cylinder head 14 and a valve assembly including an intake valve 28 and an exhaust valve 30, and may be closed off at an opposite end by a piston assembly 32. Piston assembly 32 may include a piston 34 and a piston rod 36, and may be configured to reciprocate within cylinder bore 24 so as to form a combustion chamber 38. Thus, combustion chamber 38 may be formed within cylinder bore 24 between cylinder head 14 and piston 34.

In addition to intake valve 28 and exhaust valve 30, cylinder head 14 may include an intake port 40 connected between outer mounting surface 20 and cylinder bore 24. Intake port 40 may include a substantially cylindrical section 42 and an intake chamber 44. Cylindrical section 42 may extend from outer mounting surface 20 of cylinder head 14 to intake chamber 44.

An intake air supply line 48 may be coupled to intake manifold 16 and may include a fluid cooler 50, such as an air-to-air aftercooler or other suitable fluid cooler, located upstream of intake manifold 16. Fluid cooler 50 may serve to cool the temperature of intake air to within a predetermined range. A turbocharger 52 may be connected to the intake and exhaust (not shown) of engine 10 and include a compressor section 54 connected to air supply line 48 upstream of aftercooler 50. Compressor section 54 may be used to pressurize the air to be supplied to combustion chamber 38.

Internal combustion engine 10 may also include an intake port sleeve 56. Intake port sleeve 56 may include a cylindrical portion 58 and a flange portion 60, and may be formed of a smooth material having good insulative properties. For example, intake port sleeve 56 may be formed of a thermoset composite material or a thermoplastic material suitable for the engine operating temperatures. One such group of materials includes vinylesters. The bore of intake port sleeve 56 may be smoother than the bore of intake port 40 of known internal combustion engines.

Flange portion 60 of intake port sleeve 56 may be sized to fit between outer mounting surface 20 of the cylinder head 14 and a mounting surface 62 of intake manifold 16. Flange portion 60 may include holes 64 for receiving bolt members 22 extending between intake manifold 16 and cylinder head 14. Alternatively, flange portion 60 may terminate prior to bolts 22, and thus merely be clamped between intake manifold 16 and cylinder head 14. Even further, port sleeve 56 may be formed without a flange portion 60 and be clamped in position in intake port 40 by intake manifold 16.

Cylindrical portion 58 of intake port sleeve 56 may be spaced from cylindrical section 42 of intake port 40 to form an air gap 66. Cylindrical portion 58 of intake port sleeve 56 may terminate at an outer extending section 68 to assist in aligning port sleeve 56 in intake port 40. Alternatively, outer extending section 68 may be omitted and intake port 40 formed with an inwardly extending step for receiving an end of intake port sleeve 86. Outer extending section 68, flange 60, and the cylindrical portion 58 of intake port sleeve 56 may be integrally formed or may be manufactured as separate pieces.

INDUSTRIAL APPLICABILITY

During engine operation, atmospheric air is received in intake air supply line 48 through a filter (not shown) and travels to compressor section 54 of turbocharger 52. The compressor section 54 pressurizes the atmospheric air making the air more dense, thereby increasing the quantity of oxygen available for combustion in combustion chamber 38. This increase in the quantity of air supplied to combustion chamber 38 provides for better engine efficiency and higher horsepower output. The pressurization of the intake air, however, also raises the temperature of the intake air. In order to improve engine efficiency and horsepower output, the intake air leaving compressor section 54 is fed through fluid cooler 50 to reduce the temperature and maintain the density of the intake air.

After the intake air of supply line 48 passes through fluid cooler 50, the intake air travels through intake manifold 16, intake port 40 and through intake valve 20 to combustion chamber 38. Exhaust from combustion chamber 38 may travel through exhaust valve 30, an exhaust chamber 46 and through an exhaust passageway to an exhaust manifold (not shown).

Due to the heat produced in combustion chamber 38, cylinder head 14 is normally at a temperature above that of the intake air received from fluid cooler 50. This will likely be true even with the use of an engine cooling system. Intake port sleeve 56 serves to insulate the cooled intake air from the higher temperature cylinder head 14, and thus reduce the amount of heat transferred to the intake air from cylinder head 14. The reduced heat transfer is based on the insulative properties of port sleeve 56, together with the insulation provided by air gap 66 formed between port sleeve 56 and cylindrical section 42 of intake port 40.

Intake port sleeve 56 also may reduce the friction between the intake air and intake port 40 due to the smooth bore of port sleeve 56. This reduced friction is significant in view of the many sudden changes in velocity of the intake air as intake valve 28 opens and closes during engine operation. Accordingly, the smooth bore of port sleeve 56 improves the overall volumetric efficiency of the air intake system of engine 10.

Further, flange portion 60 of intake port sleeve 56, beyond assisting to affix port sleeve 56 in position, may also further reduce the amount of heat transferred from engine 10 to the intake air. Flange portion 60 is located between cylinder head 14 and intake manifold 16 and thus may act as an insulating layer reducing the amount of heat transferred from cylinder head 14 to intake manifold 16. With less heat being transferred to intake manifold 16, heat transferred to the intake air as it flows through intake manifold 16 is reduced.

Accordingly, during an intake cycle of engine 10, intake valve 28 is opened and intake air in intake port 40 passes into combustion chamber 38. After the intake air has entered combustion chamber 38, intake valve 28 is closed. The intake air in combustion chamber 38 is then mixed with fuel, compressed by piston 34, and combusted. Exhaust valve 30 is then opened to allow exhaust gasses to flow out exhaust chamber 46 through an exhaust passageway and the exhaust manifold (not shown) to the turbocharger 52.

Other embodiments of the invention will be apparent to those skilled in the art from consideration of the specification and practice of the invention disclosed herein. For example, air gap 66 of port sleeve 56 may be filled with an insulative material, such as an insulating foam. Further, a gasket or other suitable element may be included between intake manifold 16 and cylinder head 14 to improve both the sealing and insulation between the elements. Intake port sleeve 56 may include flange 60 and cylindrical portion 58 of different materials to modify desired insulation at their respective locations. Finally, outer extending section 68 of intake port sleeve 56 may include, or be replaced with, a bend section extending from and downstream of cylindrical portion 58. The bend section may extend over abrupt cylinder head transitions located in the area joining cylindrical section 42 and intake chamber 44. The bend section may be configured to form a smooth and gradual flow transitions between the cylindrical section 42 and the intake chamber 44 so as to reduce air flow pressure drop in that area. It is intended that the specification and examples be considered as exemplary only, with a true scope and spirit of the invention being indicated by the following claims.

What is claimed is:

1. An engine comprising:

a cylinder block having at least one cylinder bore;

a cylinder head connected to the cylinder block;

an intake manifold connected to the cylinder head;

an intake port formed in the cylinder head upstream of the at least one cylinder bore, the intake port providing a passageway between the intake manifold and the at least one cylinder bore; and a removable intake port sleeve located at least partially within the intake port, the intake port sleeve having a flange portion fixed between a respective surface of the intake manifold and the cylinder head to insulate the manifold from the cylinder heads, wherein the intake port sleeve is formed of one of a thermoset composite material and a thermoplastic material.

2. The engine according to claim 1, wherein the intake port sleeve includes a cylindrical portion spaced from a wall portion of the intake port so as to form an air gap between the cylindrical portion and the wall portion.

3. An engine comprising:

a cylinder block having at least one cylinder bore;

a cylinder head connected to the cylinder block;

an intake manifold connected to the cylinder head;

an intake port formed in the cylinder head upstream of the at least one cylinder bore, the intake port providing a passageway between the intake manifold and the at least one cylinder bore; and an intake port sleeve located at least partially within the intake port, wherein the intake port is formed of one of a thermoset composite material and a thermoplastic material.

4. The engine according to claim 3, wherein the intake port sleeve is formed of a vinylester.

5. The engine according to claim 1, wherein the intake port sleeve has an inner bore having a section smoother than a bore of the intake port.

6. The engine according to claim 1, wherein a turbocharger and fluid cooler are connected to an intake air supply line of the engine.

7. An engine system comprising:

a compressor receiving intake air of the engine system;

a fluid cooler located downstream of the compressor and configured to receive compressed intake air; and an engine including a cylinder block having at least one cylinder bore, a cylinder head connected to the cylinder block, an intake manifold connected to the cylinder head, at least one intake port formed in the cylinder head, the intake port providing a passageway between the intake manifold and the at least one cylinder bore, and a removable intake port sleeve, located at least partially within the at least one intake port, the intake port sleeve having a flange portion fixed between a respective surface of the intake manifold and the cylinder head to insulate the manifold from the cylinder head, wherein the intake port sleeve is formed of one of a thermoset composite material and a thermoplastic material.

8. The engine system according to claim 7, wherein the intake port sleeve includes a cylindrical portion spaced from a wall portion of a respective intake port so as to form an air gap between the cylindrical portion and the wall portion.

9. The engine system according to claim 7, wherein the intake port sleeve is formed of a vinylester.

10. The engine system according to claim 7, wherein the intake port sleeve has an inner bore having a section smoother than a bore of a respective intake port.

11. The engine system according to claim 7, wherein the fluid cooler is an air-to-air cooler.

12. An engine comprising:

a cylinder block having at least one cylinder bore;

a cylinder head connected to the cylinder block;

an intake manifold connected to the cylinder head;

an intake port formed in the cylinder head upstream of the at least one cylinder bore, the intake port providing a passageway between the intake manifold and the at least one cylinder bore; and a removable intake port sleeve located at least partially within the intake port, the intake port sleeve having a single layered cylindrical portion spaced from a wall portion of the intake port so as to form an air gap between the cylindrical portion and the wall portion, wherein the intake port sleeve is formed of one of a thermoset composite material and a thermoplastic material.

13. The engine of claim 12, further including a flange portion fixed between a respective surface of the intake manifold and the cylinder head to insulate the manifold from the cylinder head.

14. The engine of claim 12, wherein the intake port sleeve has an inner bore having a section smoother than a bore of a respective intake port.

15. An engine comprising:

a cylinder block having at least one cylinder bore;

a cylinder head connected to the cylinder block;

an intake manifold connected to the cylinder head;

an intake poll formed in the cylinder head upstream of the at least one cylinder bore, the intake poll providing a passageway between the intake manifold and the at least one cylinder bore; and a removable intake poll sleeve located at least partially within the intake port, wherein the intake port sleeve has an inner bore having a section smoother than a bore of a respective intake port, wherein the intake port sleeve is formed of one of a thermoset composite material and a thermoplastic material.

16. The engine of claim 15, further including a flange portion fixed between a respective surface of the intake manifold and the cylinder head to insulate the manifold from the cylinder head.

17. The engine of claim 15, wherein the intake port sleeve has a single layered cylindrical portion spaced from a wall portion of the intake port so as to form an air gap between the cylindrical portion and the wall portion.

* * * * *

UNITED STATES PATENT AND TRADEMARK OFFICE

CERTIFICATE OF CORRECTION

PATENT NO. : 6,817,334 B2
DATED : November 16, 2004
INVENTOR(S) : Deforest C. Gould It is certified that error appears in the above-identified patent and that said Letters Patent is hereby corrected as shown below:

Column 6,
Line 43, Claim 15, should read as follows:
An engine comprising:

a cylinder block having at least one cylinder bore;

a cylinder head connected to the cylinder block;

an intake manifold connected to the cylinder head;

an intake port formed in the cylinder head upstream of the at least one cylinder bore, the intake port providing a passageway between the intake manifold and the at least one cylinder bore; and a removable intake port sleeve located at least partially within the intake port, wherein the intake port sleeve has an inner bore having a section smoother than a bore of a respective intake port, wherein the intake port sleeve is formed of one of a thermoset composite material and a thermoplastic material.

Signed and Sealed this

Twenty-sixth Day of April, 2005

JON W. DUDAS
*Director of the United States Patent and Trademark Office*